US006171544B1

(12) United States Patent
Anderson et al.

(10) Patent No.: US 6,171,544 B1
(45) Date of Patent: Jan. 9, 2001

(54) MULTIPLE COHERENT JET LANCE

(75) Inventors: John Erling Anderson, Somers, NY (US); Dennis Robert Farrenkopf, Bethel, CT (US); Richard Thomas Semenza, Shrub Oak, NY (US); Pravin Chandra Mathur, Bronx, NY (US); William John Mahoney, Stony Point, NY (US)

(73) Assignee: Praxair Technology, Inc., Danbury, CT (US)

( * ) Notice: Under 35 U.S.C. 154(b), the term of this patent shall be extended for 0 days.

(21) Appl. No.: 09/285,097

(22) Filed: Apr. 2, 1999

(51) Int. Cl.[7] ..... C21B 7/16
(52) U.S. Cl. ..... 266/47; 266/225; 266/268
(58) Field of Search ..... 266/225, 217, 266/268, 44, 47; 75/10.42, 502, 553, 554

(56) References Cited

U.S. PATENT DOCUMENTS

| | | | |
|---|---|---|---|
| 3,216,714 | 11/1965 | Eibl et al. | 266/34 |
| 3,427,151 | 2/1969 | Koudelka et al. | 75/59 |
| 3,889,933 | 6/1975 | Jaquay | 266/34 |
| 3,972,517 | 8/1976 | Kraizinger et al. | 266/225 |
| 5,100,313 | 3/1992 | Anderson et al. | 431/8 |
| 5,120,026 | 6/1992 | Bissonnette | 266/48 |
| 5,599,375 | 2/1997 | Gitman | 75/10.42 |
| 5,700,421 | 12/1997 | Bissonnette | 266/48 |
| 5,714,113 | 2/1998 | Gitman et al. | 266/182 |
| 5,769,923 * | 6/1998 | Nishikawa et al. | 266/225 |

FOREIGN PATENT DOCUMENTS

WO89/02051 9/1989 (WO) .

OTHER PUBLICATIONS

Stoecker et al., "Fundamental Concepts of Oxygen Cutting", AWS Fall Meeting, Cleveland, Ohio (Dec. 1957).

* cited by examiner

*Primary Examiner*—Scott Kastler
(74) *Attorney, Agent, or Firm*—Stanley Ktorides

(57) ABSTRACT

A system for establishing a plurality of coherent gas jets proximate one another using a single lance wherein plurality of gas jets are ejected from a corresponding plurality of nozzles in a lance and a flame envelope is established around the plurality of gas jets, and the jets remain distinct and do not coalesce for their length.

12 Claims, 6 Drawing Sheets

MULTIPLE COHERENT JET LANCE

TECHNICAL FIELD

This invention relates generally to the flow of gas. The invention enables the flow of more than one gas stream from a single lance such that the gas streams flow proximate to one another for an extended distance while remaining distinct.

BACKGROUND ART

It is often desired to establish a flow of gas. For example, a flow of gas may be injected into a liquid for one or more of several reasons. A reactive gas may be injected into a liquid to react with one or more components of the liquid, such as, for example, the injection of oxygen into molten iron to react with carbon within the molten iron to decarburize the iron and to provide heat to the molten iron. Oxygen may be injected into other molten metals such as copper, lead and zinc for smelting or refining purposes or into an aqueous liquid or hydrocarbon liquid to carry out an oxidation reaction. A non-oxidizing gas, such as an inert gas, may be injected into a liquid to stir the liquid in order to promote, for example, better temperature distribution or better component distribution throughout the liquid.

Sometimes it is desirable to have the gas stream flow for an extended distance at a high velocity such as a supersonic velocity. This can be done by surrounding the gas stream in a flame envelope. The flame envelope keeps ambient gas from aspirating into the gas stream and this leads to the establishment of a coherent gas stream which can flow for an extended distance without any significant decrease in the gas stream velocity or significant increase in the diameter of the gas stream.

It is often desirable to use more than one gas stream in an operation. The gas could be the same for all the gas streams, or different gases could be used for one or more of the gas streams. For example, in electric arc furnace practice or basic oxygen furnace practice it is sometimes preferable to inject oxygen into the molten metal at two or more locations rather than at a single location. Moreover, in electric arc furnace practice it may be desirable to use one or more gas streams for gas injection into the molten metal and, in addition, one or more gas streams to provide oxygen into the head space of the furnace vessel for post combustion.

When in such multiple gas stream practice it is desired that the gas streams also be coherent, this has heretofore been accomplished by using a separate injection lance for each gas stream whereby the gas streams and the fluids for the corresponding flame envelopes for each of the gas streams are provided. While such a system using multiple lances effectively provides multiple coherent gas streams, it is costly and difficult to use. These problems increase as the number of individual lances increases.

Accordingly, it is an object of this invention to provide a system for establishing multiple coherent jets wherein only a single injection lance is required.

SUMMARY OF THE INVENTION

The above and other objects, which will become apparent to one skilled in the art upon a reading of this disclosure, are attained by the present invention, one aspect of which is:

A method for establishing multiple coherent gas jets from a single lance comprising:

(A) providing a lance having an end with a plurality of nozzles, each of said nozzles having an output opening for ejecting gas from the nozzle;

(B) passing gas in a jet out from each nozzle output opening and forming a plurality of gas jets, each gas jet flowing from a nozzle output opening;

(C) passing fuel and oxidant in at least one stream out from the lance end and combusting the said fuel with the said oxidant to form a flame envelope around the plurality of gas jets; and (D) maintaining the flow of each gas jet distinct for the length of said gas jet.

Another aspect of the invention is:

A lance for establishing multiple coherent gas jets comprising:

(A) a lance having an end with a plurality of nozzles, each said nozzle having an input opening and an output opening;

(B) each said nozzle input opening communicating with a source of gas, and each said nozzle output opening disposed on the face of the lance end;

(C) at least one ejection means at the lance end face around the plurality of nozzle output openings; and (D) an extension extending from the lance end face forming a volume with which each of the plurality of nozzle output openings and the ejection mean(s) communicates.

Another aspect of the invention is:

A method for establishing multiple coherent gas jets from a single lance comprising:

(A) providing a lance having an end with a plurality of nozzles, each of said nozzles having an output opening for ejecting gas from the nozzle;

(B) passing gas in a jet out from each nozzle output opening and forming a plurality of gas jets, each gas jet flowing from a nozzle output opening;

(C) passing fuel in at least one stream out from the lance end around the plurality of gas jets and combusting the said fuel with air entrained into the fuel stream(s) to form a flame envelope around the plurality of gas jets; and (D) maintaining the flow of each gas jet distinct for the length of said gas jet.

As used herein the term "annular" means in the form of a ring.

As used herein the term "flame envelope" means a combusting stream coaxially around at least one other gas stream.

As used herein the term "length" when referring to a gas jet means the distance from the nozzle from which the gas is ejected to the intended impact point of the gas jet.

As used herein the term "distinct" when referring to a gas jet means without significantly interacting with another gas jet.

As used herein the term "contained oxygen flowrate" means the oxidant flowrate times the percent oxygen in the oxidant divided by 100. For example, 10,000 CFH pure oxygen has 10,000 CFH contained oxygen and 10,000 CFH air has about 2,100 CFH contained oxygen.

Figure 1:
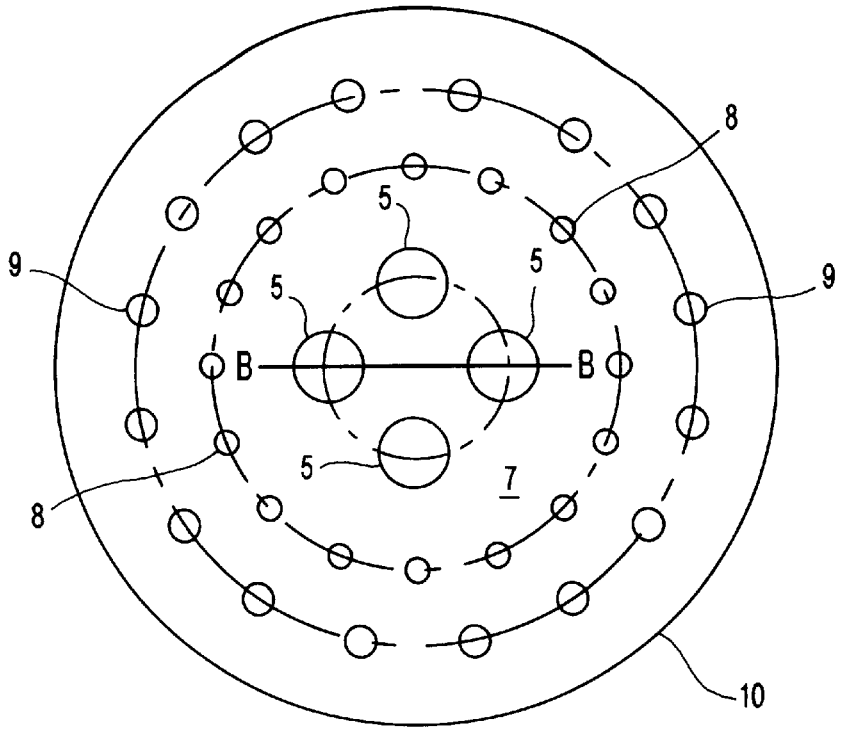
FIG. 1 is a cross sectional view of one preferred embodiment of the end or tip section of a lance which may be used in the practice of this invention.

The numerals in the drawings are the same for the common elements.

DETAILED DESCRIPTION

Figure 2:
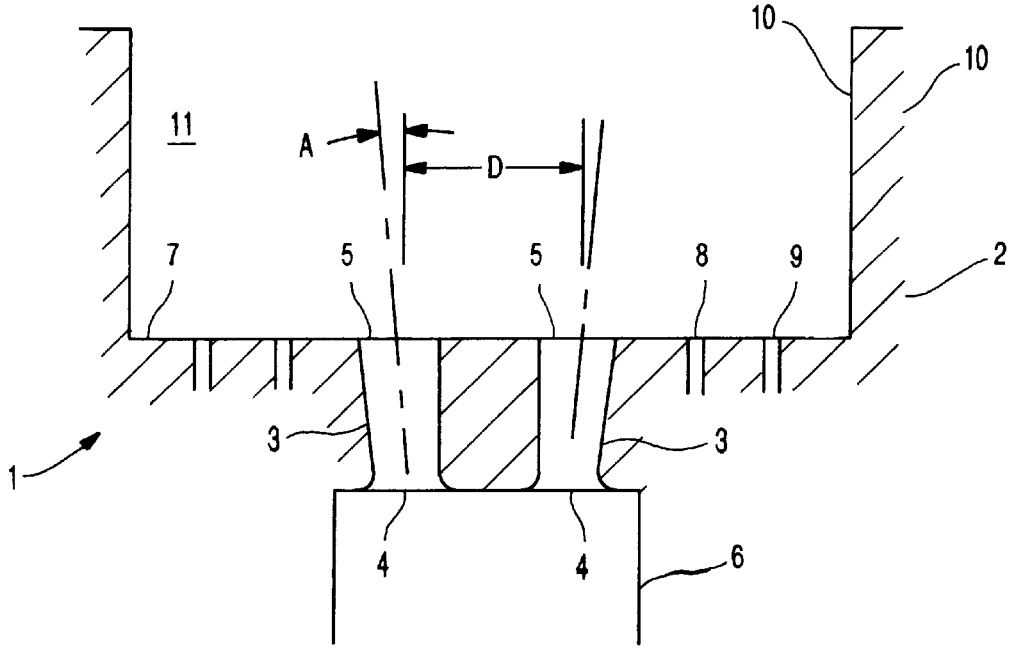
FIG. 2 is a head on view of the lance end illustrated in FIG. 1 showing the face of the lance end or tip section.

The invention will be described in detail with reference to the Drawings. Referring now to FIGS. 1 and 2, lance 1 has an end or tip section 2 housing a plurality of nozzles 3. FIG. 1 illustrates a preferred embodiment of the invention wherein the nozzles are each converging/diverging nozzles. Each of the nozzles 3 has an input opening 4 and an output opening 5. Preferably, as illustrated in the Figures, the nozzle output openings are circular, although other shapes, such as elliptical nozzle openings, may be used. The input openings 4 each communicate with a source of gas. In the embodiment illustrated in FIG. 1 all of the input openings 4 communicate with the same source of gas, that source being gas passageway 6 within lance 1. Alternatively one or more of the input openings 4 could communicate with another gas source. Gas having the same composition could be provided to all of the nozzles, or different gases could be provided to one or more of the nozzles. Indeed, a different gas could be provided to each of the nozzles. Among the gases which could be used in the practice of this invention for ejection from a nozzle one can name air, oxygen, nitrogen, argon, carbon dioxide, hydrogen, helium, gaseous hydrocarbons, other gaseous fuels and mixtures comprising one or more thereof.

Figure 3:
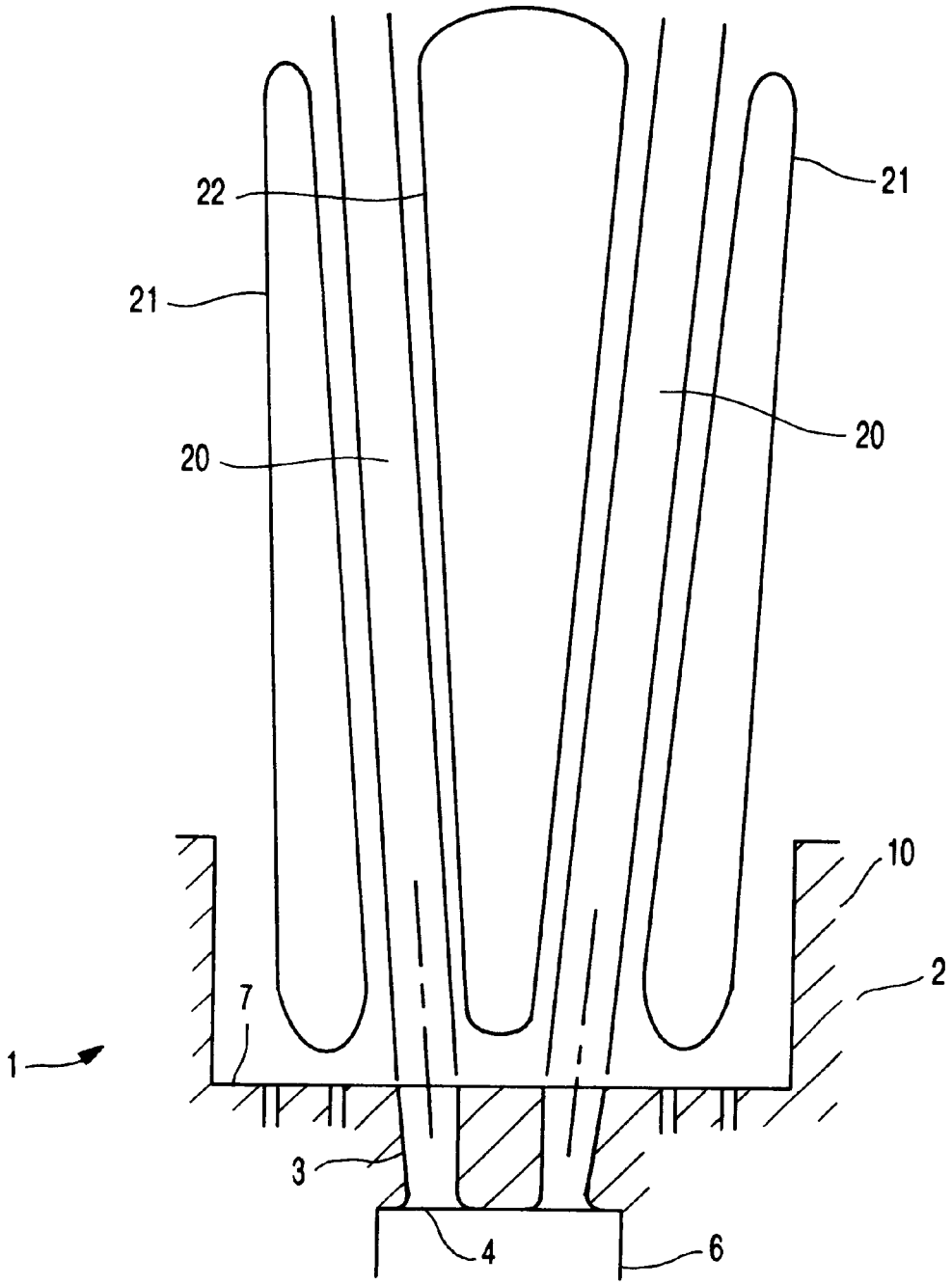
FIG. 3 is a cross sectional view of the lance end illustrated in FIG. 1 in operation.

The gas jets may come off at any angle upon ejection from the lance. The Figures illustrate certain preferred embodiments of the invention. Referring to FIGS. 1–3, the nozzles may be oriented in the lance end with their centerlines parallel with the centerline of the lance. As illustrated in FIG. 1, the nozzles are oriented in the lance end with their centerlines at an outward angle A to the centerline of the lance. Angle A may be up to 60 degrees or more and preferably is in the range of from 0 to 30 degrees, most preferably within the range of from 0 to 15 degrees. Preferably the throat diameter of the nozzles is within the range of from 0.25 to 3 inches and the diameter of output openings 5 is within the range of from 0.3 to 4 inches. Preferably the nozzle centerlines form a circle on the face 7 of lance end 2 having a diameter D. Preferably D is at least 0.4 inch and no more than 10 inches and most preferably is within the range of from 0.5 to 8 inches.

If desired, the nozzles may be oriented so that one or more jets are ejected from the lance at an inward angle to the lance centerline.

Gas is ejected out from each of the nozzle output openings 5, preferably at a supersonic velocity and generally within the range of from 500 to 10,000 feet per second (fps), to form a plurality of gas jets, each gas jet flowing outwardly from a nozzle output opening.

The lance end also has at least one ejection means, preferably an annular ejection means, for passing at least one gas stream out from the nozzle, preferably concentrically around the plurality of gas jets. The gas stream or streams passed out from the ejection means can be in any effective shape and need not go completely around the plurality of gas jets. When one annular ejection means is employed the concentric gas stream preferably comprises a mixture of fuel and oxidant. In one embodiment of the invention the injection means may provide only fuel, and the oxidant needed for the combustion with the fuel to form the flame envelope may come from air entrained into the fuel stream or streams. Preferably, as illustrated in FIGS. 1 and 2, the lance end has a first annular ejection means 8 and a second annular ejection means 9 for passing respectively fuel and oxidant out from the lance in two concentric streams. The fuel may be any fluid fuel such as methane, propane, butylene, natural gas, hydrogen, coke oven gas, or oil. The oxidant may be air or a fluid having an oxygen concentration which exceeds that of air. Preferably the oxidant is a fluid having an oxygen concentration of at least 30 mole percent, most preferably at least 50 mole percent. Preferably the fuel is provided through the first annular ejection means and the oxidant is provided through the second annular ejection means when oxygen is the gas ejected from the nozzles. When an inert gas is ejected from the nozzles, preferably the oxidant is provided through the first annular ejection means and the fuel is provided through the second annular ejection means. If desired, the fuel and oxidant may be provided using three annular ejection means with the oxidant provided from the inner and outer annular ejection means and the fuel provided from the middle annular ejection means. Although one or both of the annular ejection means may form a continuous ring opening on lance face 7 from which the fuel or oxidant is ejected, preferably, as illustrated in FIG. 2, both the first and second annular ejection means form a series of discrete openings, e.g. circular holes, from which the two concentric streams of fuel and oxidant are ejected. The ejection means need not provide fuel and oxidant completely around the gas jets.

The first annular ejection means at the lance end face forms a ring around the plurality of nozzle output openings and the second annular ejection means at the lance end face forms a ring around the first annular ejection means. The fuel and oxidant passed out of the first and second annular ejection means combust to form a flame envelope around the plurality of gas jets. If the environment into which the fuel and oxidant is injected is not hot enough to auto ignite the mixture, a separate ignition source will be required to initiate the combustion. Preferably the flame envelope is moving at a velocity less than that of each of the gas jets and generally at a velocity within the range of from 100 to 1000 fps.

FIG. 3 illustrates in cross section the flame envelope around the coherent jets 20. Near the lance face there will be a single flame envelope with all of the coherent jets contained within the flame envelope as illustrated by flame envelope 21 in FIG. 3. Depending upon the lance design and the operating conditions, further downstream of the lance face there may be observed a single flame envelope with all of the coherent jets contained within that flame envelope and/or individual flame envelopes around each of the coherent jets. In FIG. 3 for illustrative purposes there is shown such individual flame envelopes represented by combusting streams 21 and 22.

Preferably, as illustrated in FIG. 1, extension 10, having a length generally within the range of from 0.5 to 6 inches, extends from lance end face 7 forming a volume 11 with which each of the plurality of nozzle output openings 5, the first annular ejection means 8 and the second annular ejection means 9 communicates, and within which each of the plurality of gas jets and the flame envelope around the plurality of gas jets initially form. Volume 11 formed by extension 10 establishes a protective zone which serves to protect the gas streams and the fuel and oxidant immediately upon their outflow from lance end 2 thus helping to achieve coherency for each gas jet. The protective zone induces recirculation of the fuel and oxidant around the gas jets and in some cases around each individual gas jet. Thus, even though fuel and oxidant may not be provided initially into the volume 11 completely around the gas jets, the recirculation of the fuel and oxidant within the protective zone serves to ensure that one or more effective flame envelopes are formed so as to establish coherency for each gas jet.

The flow of each gas jet remains distinct from the flow of all the other gas jets passed out from the nozzle openings of lance 1 for the entire length of such gas jet until the gas jet reaches its target. Such a target may be, for example, the surface of a pool of liquid such as molten metal or an aqueous liquid, or may be a solid or a gaseous target such as with another gas jet with which the gas jet interacts. This is in contrast to what happens when conventional gas jets are ejected from the same lance. With such conventional gas jets, the jets quickly merge or flow together to form a single gas jet. The gas jets remain distinct for a distance of at least 10 nozzle exit diameters, typically at least 20 nozzle exit diameters, and generally for a distance within the range of from 20 to 100 nozzle exit diameters.

It has been found that as the total flowrate of the gas jets passed out from the nozzles increases, the total flowrate of the fuel and oxidant passed out from the ejection means to form the flame envelope also increases but at a lesser rate than the increase for the gas jet flowrate. When the total flowrate of the gas jets passed out from the nozzles is within the range of from 20,000 to 100,000 CFH, the total flowrate of the fuel forming the flame envelope is preferably within the range of from 2 to 15 million BTU per hour (MMBTU/hr) and the total flowrate of the contained oxygen in the oxidant forming the flame envelope is preferably within the range of from 2,000 to 15,000 CFH. When the total flowrate of the gas jets passed out from the nozzles is within the range of from 400,000 to 2,000,000 CFH, the total flowrate of the fuel forming the flame envelope is preferably within the range of from 10 to 70 MMBTU/hr and the total flowrate of the contained oxygen in the oxidant forming the flame envelope is preferably within the range of from 10,000 to 70,000 CFH.

Tests were carried out to demonstrate the effectiveness of the invention, using embodiments of the invention similar to those illustrated in FIGS. 1–3 and using oxygen as the gas passed from the nozzles, and the tests and results are discussed below and shown in FIG. 4 along with the results of a comparative test. These tests are reported for illustrative or comparative purposes and are not intended to be limiting.

Four nozzles were set around a circle surrounding a lance axis. Each nozzle was a converging/diverging nozzle with throat and exit diameters of 0.27 and 0.39 inches respectively. The circle diameter (D) was ¾". The angle (A) between the coherent jets and the lance axis was 0 degrees and the perimeter of each jet was spaced 0.14 inch from the perimeters of adjacent jets. Natural gas and oxidant for the flame envelope were supplied through two rings of holes: the inner ring (16 holes, 0.154" diameter, on a 2" diameter circle) for natural gas; and the outer ring (16 holes, 0.199" diameter on a 2¾" diameter circle) for the oxidant which, in this case, was commercially pure oxygen having an oxygen concentration of about 99.5 mole percent. An extension (3½" diameter, 2" long) was attached to the end of the lance to provide gas recirculation to stabilize the flames.

Tests were run with a supply pressure of 150 pounds per square inch gauge (psig) for the main oxygen passed out from the nozzles. At that pressure just upstream of the nozzle, the flow rate of oxygen through each nozzle was 10,000 cubic feet per hour (CFH) for a total flow of 40,000 CFH for all four nozzles. The calculated exit temperature, velocity and Mach Number for the coherent jets at the nozzle exits were −193° F., 1700 fps and Mach 2.23 respectively. The natural gas and oxygen flow rates to the inner and outer rings of holes were 5,000 and 6,000 CFH respectively.

Four distinct coherent jets were visually observed and there was no apparent interaction between the jets. Velocities, calculated from pitot tube measurements in plane B—B as shown in FIG. 2 taken at 18, 24 and 30 inches from the nozzle face, are shown as curves A, B, and C in FIG. 4.

Figure 4:
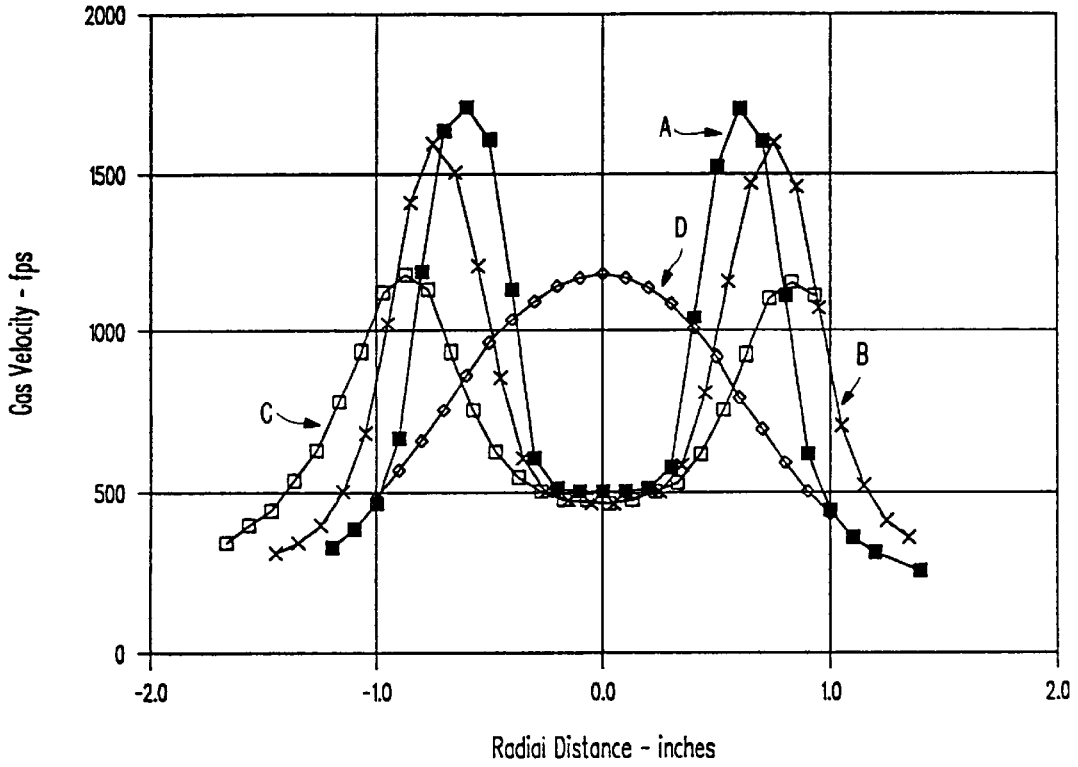
FIGS. 4 and 5 are graphical representations of test results achieved using the invention as well as some comparative results.

For normal jets in close proximity, entrainment draws the jets together to form a single jet as is shown by curve D in FIG. 4 which shows the results obtained when the above described test was repeated but without the flame envelope around the four jets. The pitot tube measurements shown in Curve D were taken at 10.25 inches from the nozzle face. This entrainment did not occur for the tests of the invention described herein even though the coherent jets were very close together. This was very striking particularly with the four coherent jets parallel to the lance axis and the perimeter of each jet being less than ¼" from the perimeter of the adjacent jets. Each jet acted as if it were a single jet in free space remaining coherent for a considerable distance from the nozzle face. A very effective means of providing flame envelopes for multiple coherent jets is through two rings of holes (for natural gas and oxygen) surrounding all of the coherent jets. This arrangement, along with an extension to bring about gas recirculation near the nozzle, results in uniform flames around each coherent jet.

Figure 5:
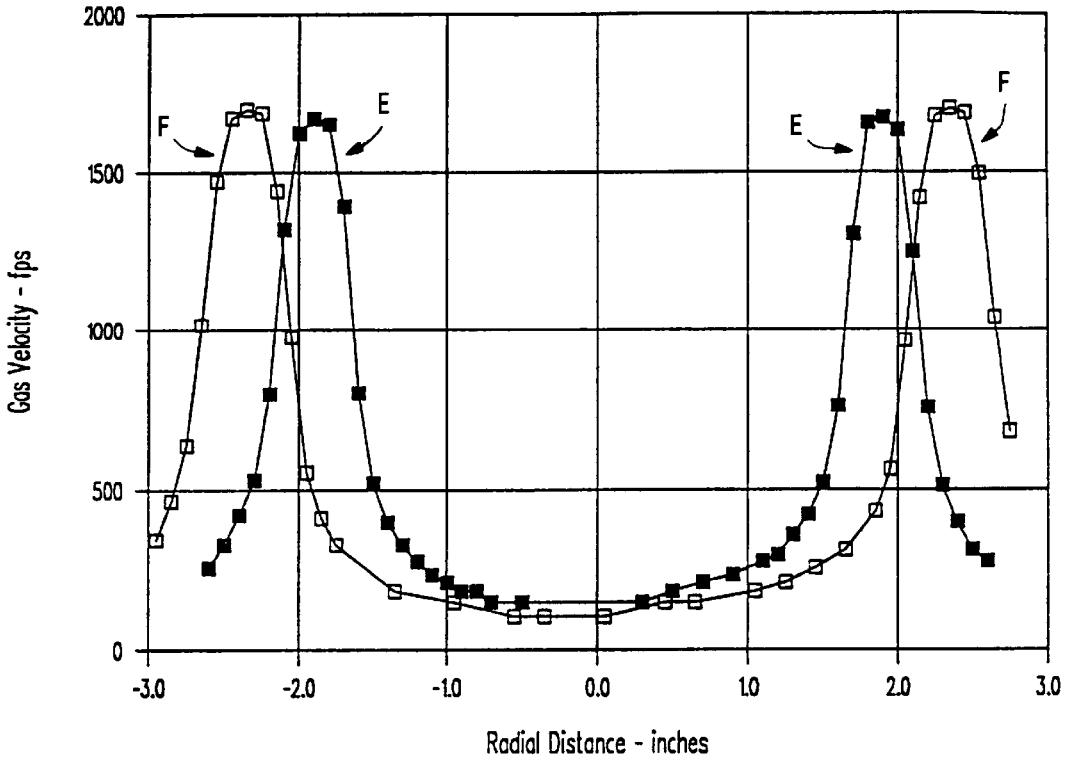

FIG. 5 illustrates the results obtained with another embodiment of the invention, similar to that illustrated in FIG. 1 except that this embodiment employed only two nozzles. Each nozzle opening was oriented at an outward angle of 5 degrees from the lance axis and the distance between the centerlines of the nozzle openings was 0.875 inch. Oxygen at a flowrate of 20,000 CFH passed through each nozzle and at the nozzle exits the separation between the perimeters of the nozzle exits was 0.32 inch. The natural gas and secondary oxygen flowed from the two annular rings of holes at 5,000 CFH and 4,000 CFH respectively. Two distinct coherent jets were formed and velocity profiles at 18 inches (curve E) and 24 inches (curve F) are shown in FIG. 5. There was no interference between the two jets and each jet acted as if it were a single jet in free space.

Figure 6:
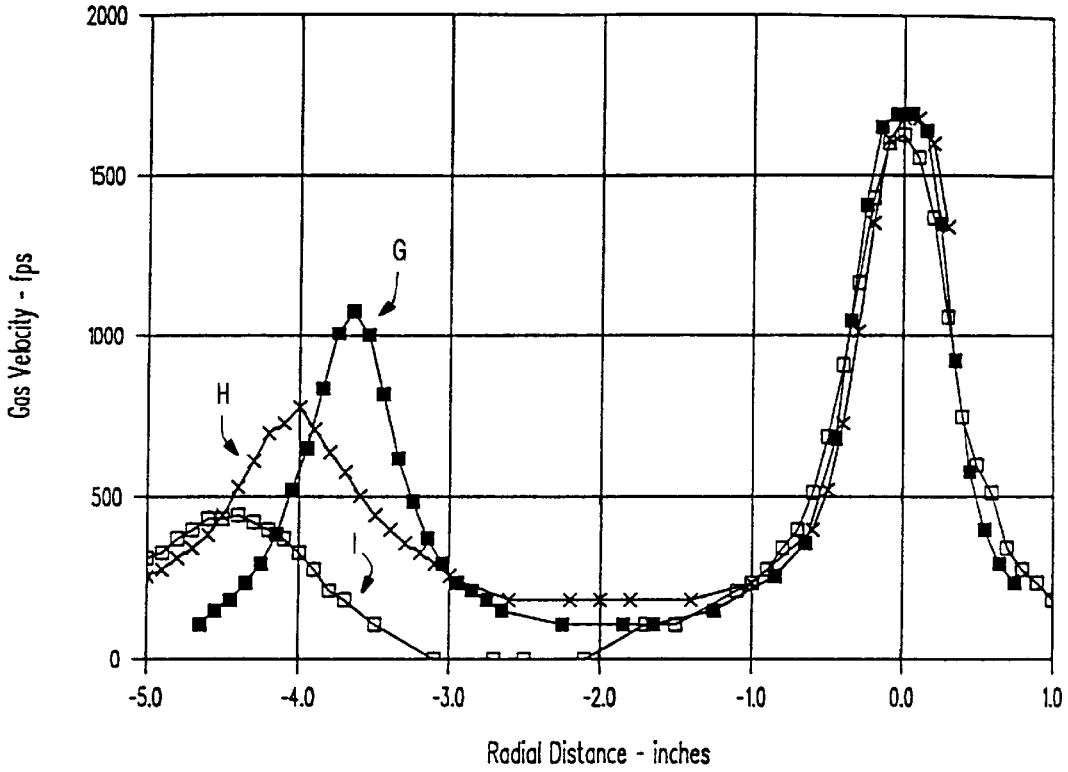
FIG. 6 is a graphical representation of test results achieved using the embodiment of the invention illustrated in partial cross section in FIG. 7.
Figure 7:
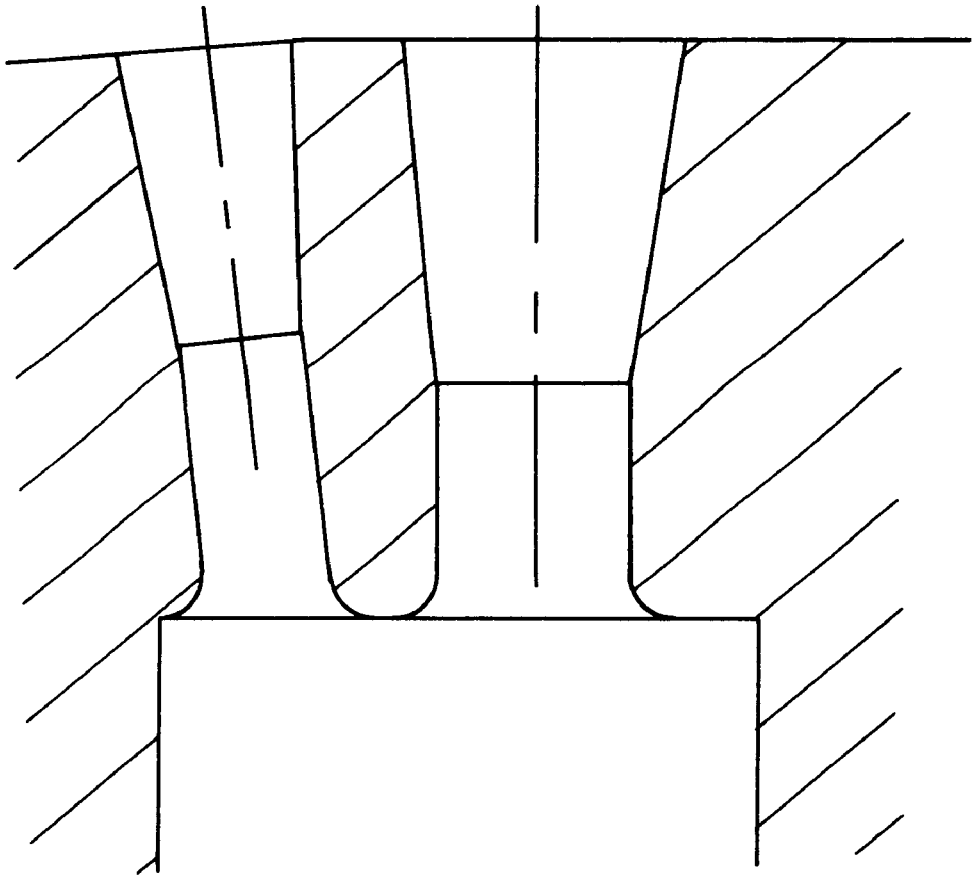

FIG. 6 illustrates the results obtained with another embodiment of the invention illustrated in cross section in FIG. 7. In this embodiment the lance end had two nozzles with two holes or output openings with the distance between the centerlines of the holes being 0.725 inch. The first nozzle was designed for 30,000 CFH oxygen with the axis parallel to the lance axis. The second nozzle was designed for 10,000 CFH oxygen with the axis angled out 5 degrees from the lance axis. At the exits the separation between the perimeters of adjacent holes was 0.20 inch. The natural gas and secondary oxygen to the rings of holes (not shown) were 5,000 and 4,000 CFH respectively. The flow rates through the two converging-diverging nozzles differed by a factor of three. Velocity profiles at 30, 34 and 38 inches from the lance face are shown in FIG. 6, as curves G, H, and I. For the high flow jet (30,000 CFH oxygen), the profile remained essentially the same over the range of distances from the nozzle face. The coherent jet remained parallel to the lance axis. As expected, the low flow jet (10,000 CFH oxygen) started to lose its coherency beyond 30 inches from the lance face. The location of the peaks indicate that the jet angled out about 5.5 degrees from the lance axis. This was close in value to the 5 degree angle at the lance face. There was no apparent interference between the two jets. These results illustrate the flexibility that is possible with multiple hole coherent jet lances. For example, oxygen for both lancing and post combustion would be possible with a single multiple nozzle lance. One jet could be directed towards the molten bath for lancing while the smaller jet could be directed above the bath for post combustion. This could all be accomplished with a multiple coherent jet lance.

In one particularly preferred embodiment of the invention which is employed in the operation of a basic oxygen furnace, there is employed from 3 to 6 gas jets each at a diverging angle to the other and each at a supersonic velocity wherein each jet has the same gas composition and the flame envelope is formed using two concentric streams of fuel and oxidant around the plurality of gas jets.

Although the invention has been described in detail with reference to certain preferred embodiments, those skilled in the art will recognize that there are other embodiments of the invention within the spirit and the scope of the claims.

What is claimed is:

1. A method for establishing multiple coherent gas jets from a single lance comprising:

(A) providing a lance having an end with a plurality of nozzles, each of said nozzles having an output opening for ejecting gas from the nozzle;

(B) passing gas in a jet out from each nozzle output opening and forming a plurality of coherent gas jets, each coherent gas jet flowing from a nozzle output opening;

(C) passing fuel and oxidant in at least one stream out from the lance end and combusting the said fuel with the said oxidant to form a flame envelope around the plurality of coherent gas jets downstream of the lance; and (D) maintaining the flow of each coherent gas jet distinct for the length of said coherent gas jet.

2. The method of claim 1 wherein at least two gas jets flow in streams which diverge.

3. The method of claim 1 wherein at least two gas jets flow in streams which are parallel.

4. The method of claim 1 wherein the fuel and oxidant are passed respectively in two concentric streams out from the lance end around the plurality of gas jets.

5. The method of claim 1 wherein each gas jet has a supersonic velocity.

6. The method of claim 1 wherein at least one of the gas jets comprises oxygen.

7. The method of claim 1 wherein there is formed from 3 to 6 gas jets, each of said gas jets flowing at a diverging angle to the other gas jets, at a supersonic velocity and having the same gas composition as each of the other gas jets, and wherein the flame envelope is formed by passing fuel and oxidant in two concentric streams out from the lance end around the plurality of gas jets.

8. A lance for establishing multiple coherent gas jets comprising:

(A) a lance having an end with a plurality of nozzles, each said nozzle having an in put opening and an output opening;

(B) each said nozzle input opening communicating with a source of gas, and each said nozzle output opening disposed on the face of the lance end;

(C) a first annular ejection means at the lance end face around the plurality of nozzle output openings for passing fuel out from the lance and a second annular ejection means at the lance end face around the first annular ejection means for passing oxidant out from the lance; and (D) an extension extending from the lance end face forming a volume with which each of the plurality of nozzle output openings and the first and second annular ejection means communicates.

9. The lance of claim 8 wherein each nozzle input opening communicates with the same source of gas.

10. A method for establishing multiple coherent gas jets from a single lance comprising:

(A) providing a lance having an end with a plurality of nozzles, each of said nozzles having an output opening for ejecting gas from the nozzle;

(B) passing gas in a jet out from each nozzle output opening and forming a plurality of coherent gas jets, each coherent gas jet flowing from a nozzle output opening;

(C) passing fuel in at least one stream out from the lance end around the plurality of coherent gas jets and combusting the said fuel with air entrained into the fuel stream(s) to form a flame envelope around the plurality of coherent gas jets downstream of the lance; and (D) maintaining the flow of each coherent gas jet distinct for the length of said coherent gas jet.

11. The method of claim 1 wherein the oxidant is passed out from the lance at a flowrate so as to be at least 40 percent of the stoichiometric amount required to combust with the fuel passed out from the lance.

12. A lance for establishing multiple coherent gas jets comprising:

(A) a lance having an end with a plurality of nozzles, each said nozzle having an input opening and an output opening;

(B) each said nozzle input opening communicating with a source of gas, and each said nozzle output opening disposed on the face of the lance end and wherein at least two nozzle input openings communicate with different sources of gas;

(C) at least one ejection means at the lance end face around the plurality of nozzle output openings; and (D) an extension extending from the lance end face forming a volume with which each of the plurality of nozzle output openings and the ejection means communicates.

* * * * *